US006739649B2

(12) United States Patent
Kelly et al.

(10) Patent No.: US 6,739,649 B2
(45) Date of Patent: May 25, 2004

(54) CHILD SEAT

(75) Inventors: Brian S. Kelly, Orchard Park, NY (US); Bryan M. Brown, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 130 days.

(21) Appl. No.: 09/888,582

(22) Filed: Jun. 26, 2001

(65) Prior Publication Data

US 2002/0195862 A1 Dec. 26, 2002

(51) Int. Cl.[7] ..... A47D 1/02
(52) U.S. Cl. ..... 297/16.1; 297/440.1; 297/DIG. 11
(58) Field of Search ..... 297/440.1, DIG. 11, 297/376, 362, 373, 327, 452.2, 432.13, 16.1, 440.2, 440.22

(56) References Cited

U.S. PATENT DOCUMENTS

| | | | | |
|---|---|---|---|---|
| 1,641,952 A | * | 9/1927 | Abraham | 297/255 |
| 2,628,666 A | * | 2/1953 | Hall | 297/174 R |
| 2,672,916 A | | 3/1954 | Kenney | |
| 2,679,282 A | | 5/1954 | Anderegg | |
| 2,691,410 A | * | 10/1954 | Boucher | 297/45 |
| 2,713,890 A | | 7/1955 | Mack | |
| 2,848,040 A | | 8/1958 | Chernivsky | |
| 3,004,793 A | | 10/1961 | Loomis | |
| 3,017,220 A | | 1/1962 | Chernivsky | |
| 3,358,679 A | | 12/1967 | Borrelli | |
| 3,572,827 A | | 3/1971 | Merelis et al. | |
| 3,695,685 A | | 10/1972 | Lamb | |
| 4,226,467 A | | 10/1980 | Boudreau | |
| 4,266,807 A | * | 5/1981 | Griffin | 280/42 |
| 4,371,206 A | | 2/1983 | Johnson, Jr. | |
| 4,553,786 A | | 11/1985 | Lockett, III et al. | |
| 4,634,177 A | | 1/1987 | Meeker | |
| 4,674,795 A | * | 6/1987 | Nelson | 297/239 |
| 4,836,573 A | | 6/1989 | Gebhard | |
| 5,187,826 A | | 2/1993 | Mariol | |
| 5,269,591 A | | 12/1993 | Miga, Jr. et al. | |
| 5,308,143 A | | 5/1994 | Cheng et al. | |
| 5,411,315 A | * | 5/1995 | Greenwood | 297/440.11 |
| 5,451,095 A | * | 9/1995 | Riback | 297/354.12 |
| 5,460,430 A | * | 10/1995 | Miga et al. | 297/452.13 |
| 5,503,458 A | | 4/1996 | Petrie | |
| 5,507,564 A | * | 4/1996 | Huang | 297/256.13 |
| 5,509,721 A | * | 4/1996 | Huang | 297/188.1 |
| 5,617,594 A | | 4/1997 | Chien | |
| 5,622,376 A | | 4/1997 | Shamie | |
| 5,868,459 A | | 2/1999 | Welsh, Jr. | |
| 6,341,816 B1 | * | 1/2002 | Chen et al. | 297/16.1 |

FOREIGN PATENT DOCUMENTS

| | | |
|---|---|---|
| DE | 33 04 443 | 8/1984 |
| GB | 2316978 | 11/1998 |

* cited by examiner

*Primary Examiner*—Peter M. Cuomo
*Assistant Examiner*—Stephanie Harris
(74) *Attorney, Agent, or Firm*—Edell, Shapiro & Finnan, LLC

(57) ABSTRACT

A frame for a child seat includes an upper frame and a lower frame connected to the upper frame. The lower frame has left and right members that can be connected to each other such that the left and right members are positionable relative to one another between a first position and a second position when the lower frame is disconnected from the upper frame. A second frame can be rotatable between an angularly spaced position and a collapsed position along bends formed on a first frame portion.

37 Claims, 9 Drawing Sheets

CHILD SEAT

BACKGROUND OF THE INVENTION

1. Field of the Invention

The present invention relates to a child seat and more particularly, to a frame for a child seat.

2. Discussion of the Related Art

Conventional child seats include features such as backrests that can recline and folding seat frames. A folding seat frame provides a user with a seat which may be collapsed for transport or storage. The frame structure must be strong enough to adequately support a child, as well as be easy to fold and unfold without the use of tools. Many known seat frame structures employ a complicated linkage system. Such seats are bulky, unnecessarily complicated to operate and costly to produce and ship.

Also, the construction of conventional seat frames prevents the frame from folding substantially flat. The latter concern relates to the packing size for the seat. Packing size is important as it affects the costs for shipment.

In view of these and other drawbacks and limitations in the prior art, there exists a need for a child seat that can be folded into a compact configuration, both in the context of an end user's desire for a child seat that may be easily collapsed for storage and transport and for reducing shipping costs.

SUMMARY OF THE INVENTION

Accordingly, the present invention is directed to a child seat that substantially obviates one or more of the problems due to limitations and disadvantages of the related art.

An object of the present invention is to provide a child seat that has a simple, lightweight folding frame.

Another object of the present invention is to provide a child seat that has a minimum packing size.

Another object of the present invention is to provide a child seat that is simple to operate and reduces manufacturing and shipping costs.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

A frame assembly of one embodiment of a child seat includes an upper member including left and right ends, a left and right hub assembly, each of the hub assemblies including a first housing coupled to the left and right ends and a second housing, a lower frame including left and right members having respective forward and rearward ends, wherein the forward ends are connected to the second receptacles when the frame assembly is in the assembled configuration and wherein at least one of the forward ends is disconnected from a respective second receptacle when the frame assembly is in the disassembled configuration, and a pivot connecting the rearward ends, wherein when the frame assembly is in the disassembled configuration, at least one of the left and right members are rotatable about the pivot so as to allow the at least one of the left and right members to be positionable between a first and second angular position relative to the other.

In another embodiment, a frame assembly includes an upper frame including left and right ends, a lower frame including left and right members each having a forwardly extending first section, each of the first sections having a forward end, wherein the forward ends are connected to the left and right ends, respectively, when the frame assembly is in the assembled configuration and wherein at least one of the forward ends is disconnected from the respective left and right ends when the frame assembly is in the disassembled configuration; and a second section extending rearwardly from each of the first sections, the second sections being connected to each other by a coupling that permits relative motion between the left and right members such that the left and right members are positionable between a first orientation wherein at least the left and right forward ends are positioned at a first distance from each other and a second orientation wherein the at least the left and right forward ends are positioned at a second distance from each other, the first distance being greater than the second distance, wherein when the frame assembly is in the assembled configuration, the forward ends are positioned at the first distance from each other and wherein when the frame assembly is in the disassembled configuration, the forward ends are positioned at the second distance from each other.

In another embodiment, a child seat includes a first frame including a seat back portion and left and right ends, a bend formed between the seat back portion and each of the left and right ends and a second frame having left and right ends coupled to the first frame at a position located along a respective one of the bends.

In another embodiment, a method for assembly of a child's seat by a consumer includes the steps of providing an upper frame including a seating area and left and right seat support ends extending forwardly and downwardly therefrom, providing a lower frame coupling at the left and right seat support ends, the lower frame coupling including left and right lower frame housings, providing a lower frame portion including left and right ground-engaging frame members each having forward and rearward ends, providing a pivot connection connecting the rearward ends of the frame members at the rearward ends thereof, rotating the frame members about the rearward ends so as to position the forward ends from a disassembled, proximal position to a deployed distal position with respect to each other, coupling the lower frame to the upper frame by inserting the forward ends into the left and right lower frame housings, rotating the lower frame coupling relative to the upper frame coupling so as to configure the seat from a folded to a deployed position.

It is to be understood that both the foregoing general description and the following detailed description are exemplary and explanatory only and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
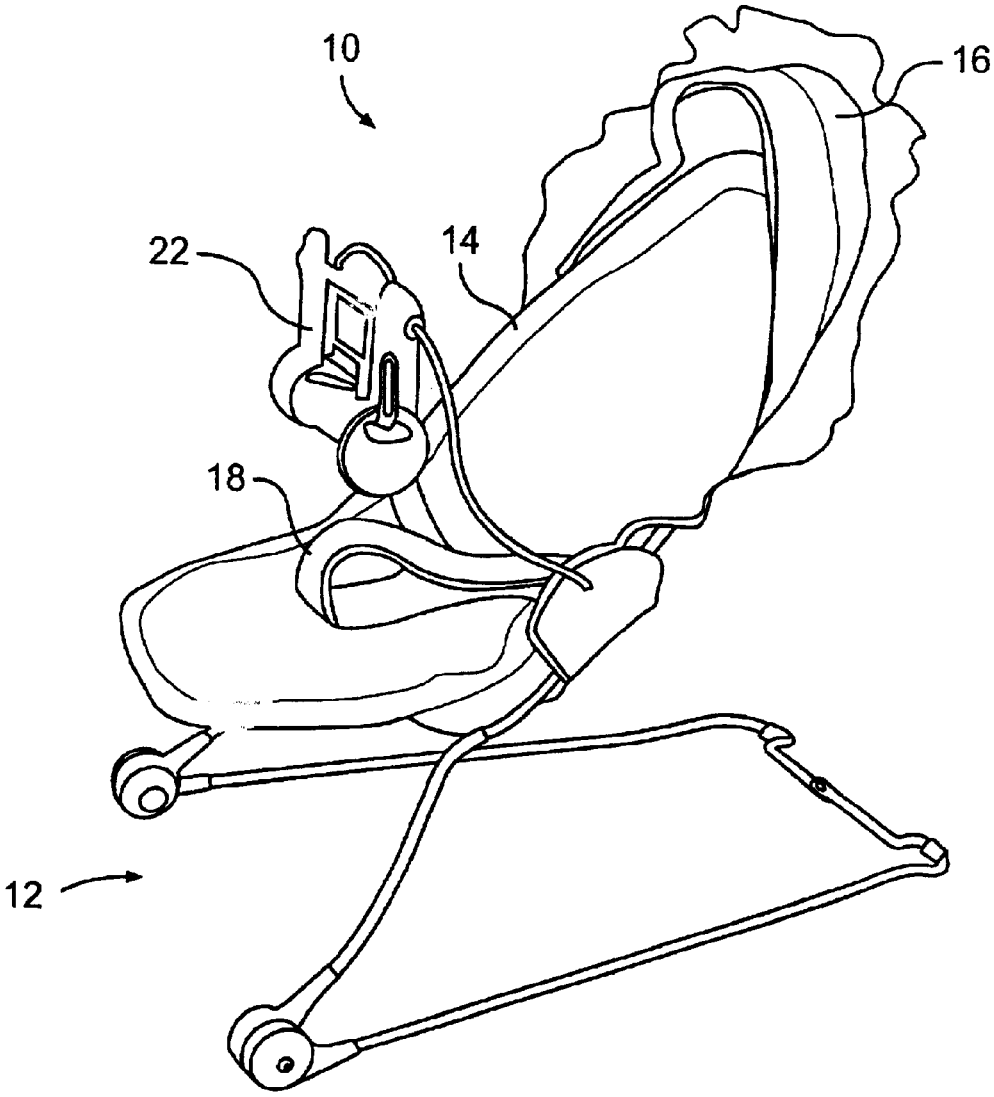
FIG. 1 illustrates a perspective view of a child seat according to a preferred embodiment of the invention.
Figure 2:
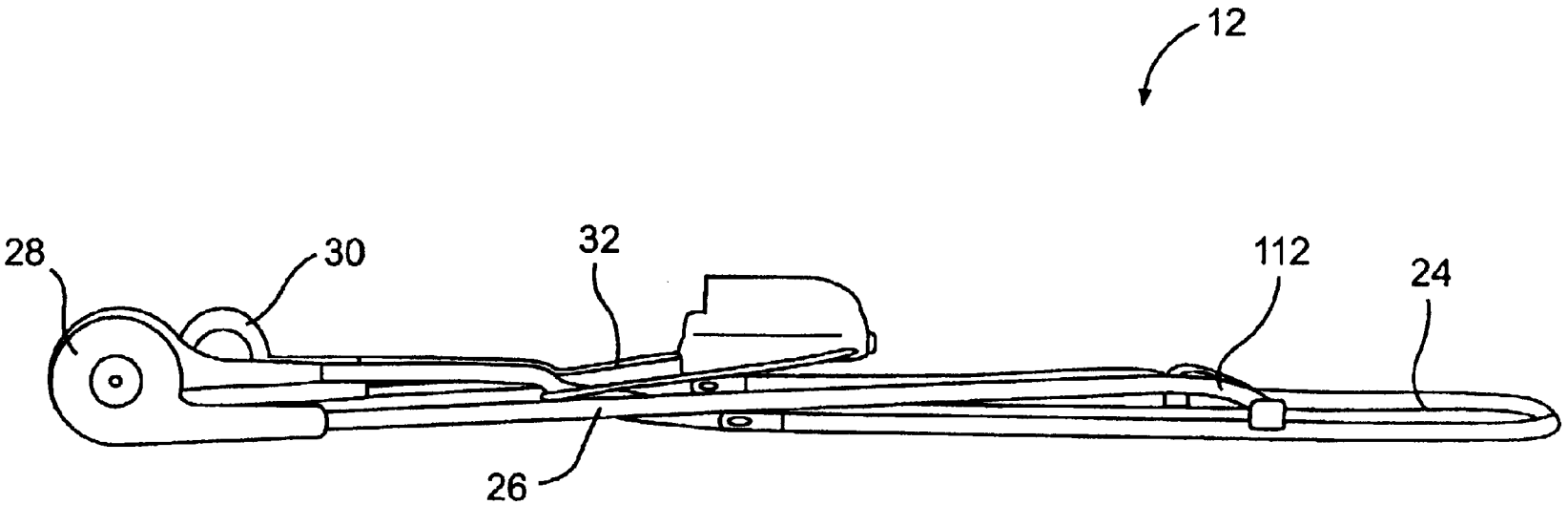
FIG. 2 shows a side view of the frame of the child seat of FIG. 1, where the frame is in a folded position.
Figure 3:
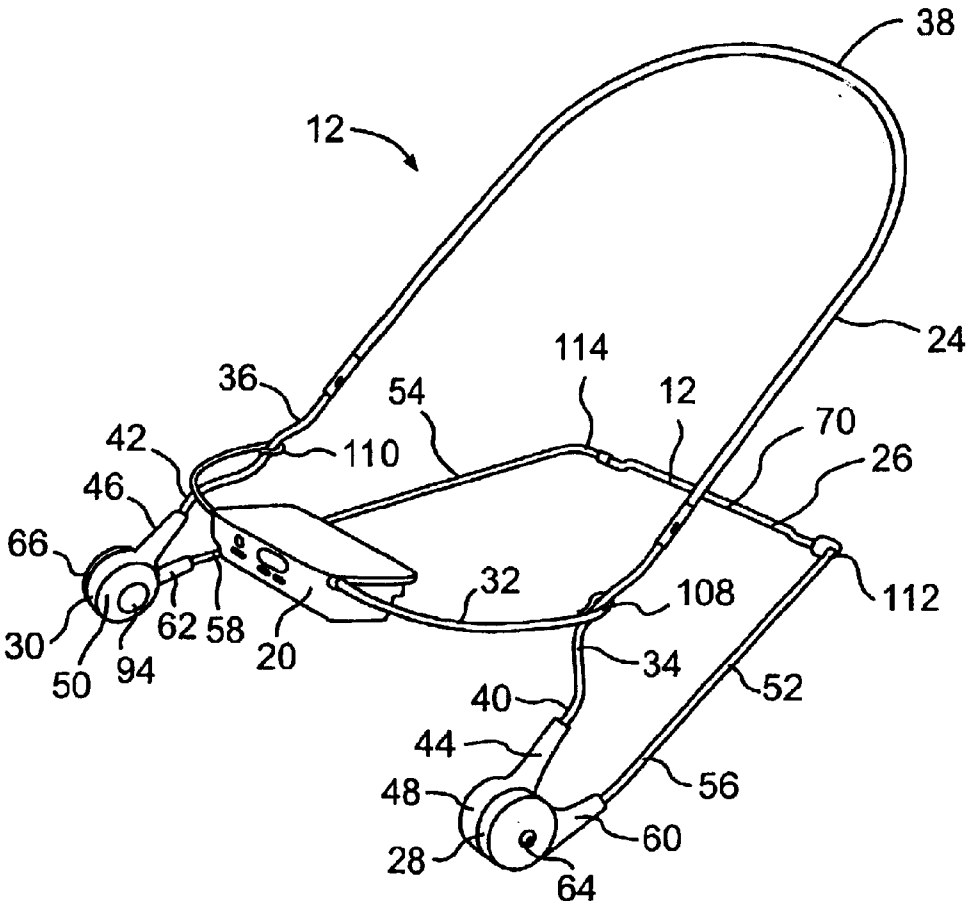
FIG. 3 shows a perspective view of the frame of the child seat of FIG. 1.

FIGS. 1 and 3 illustrate a preferred embodiment of the child seat of the invention. In this embodiment, the child seat is configured as a child bouncer 10. A frame assembly 12 supports soft goods 14 that can include a canopy 16. The soft goods 14 provides a child seating area. Other options for the child bouncer include a harness 18 to secure the child in the child bouncer 10, a vibrator 20 and a toy bar 22. FIG. 2 shows frame assembly 12 in its folded state.

Referring to FIGS. 2 and 3, the frame assembly 12 includes an upper frame 24 pivotally connected to a lower frame 26. Preferably, a pair of hub assemblies 28, 30 are used to connect upper and lower frames 24, 26. An intermediate frame 32 is pivotally connected to the upper frame 24 at bends 34, 36 (curved portions). These pivotal connections support intermediate frame 32 in its deployed position and permit the frame assembly 12 to fold substantially flat, as shown in FIG. 2.

In the preferred embodiment, the upper, lower and intermediate frames 24, 26, 32 are formed from wire form stock and the hub assemblies 28, 30 are molded from plastic. Each frame 24, 26, 32 may be formed from another suitable material.

Figure 4:
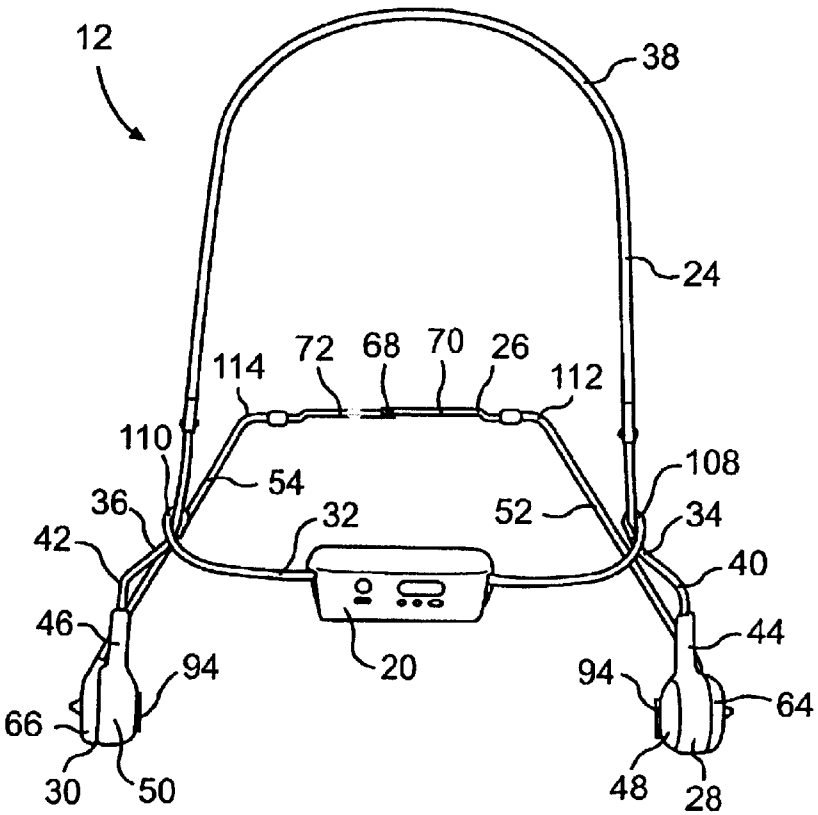
FIG. 4 shows a front view of the frame of the child seat of FIG. 3.

FIGS. 3 and 4 best show the overall features of the frame assembly 12. The upper frame 24 includes a seat back portion 38 connected to left and right ends 40, 42 by the respective bends 34, 36. The seat back portion 38 supports the majority of the soft goods 14 and the intermediate frame 32 supports the seat bottom and footrest areas of the soft goods 14. The hub assemblies 28, 30 can be constructed to permit positioning of the seat back portion 38 in a plurality of reclined positions.

First receptacles 44, 46 of the hub assemblies 28, 30 receive the left and right ends 40, 42 of the upper frame 24. Preferably, first receptacles 44, 46 are integrally formed with first housings 48, 50 of the hub assemblies 28, 30.

Figure 5:
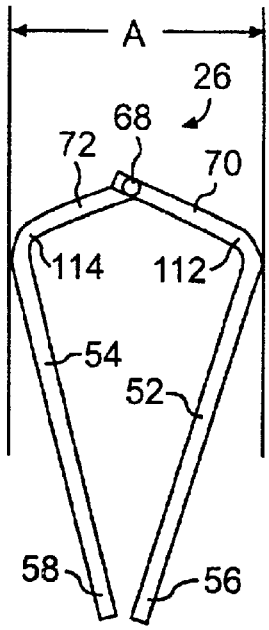
FIG. 5 shows a portion of the lower frame of the child seat of FIG. 3 in a folded position.
Figure 6:
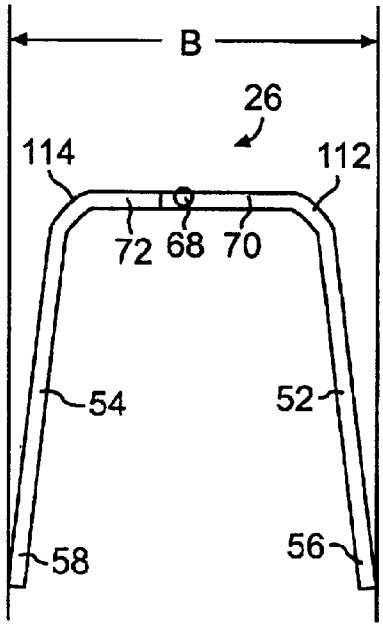
FIG. 6 shows a portion of the lower frame of the child seat of FIG. 3 in a deployed position.

The lower frame 26 preferably includes L-shaped left and right members 52, 54 having respective forward ends 56, 58 removably connected to second receptacles 60, 62 in any conventional manner. Preferably, second receptacles 60, 62 (FIG. 3) are integrally formed with second housings 64, 66 of the hub assemblies 28, 30. A pivot 68 (FIG. 4) connects the respective rearward ends 70, 72 of the left and right members 52, 54. The pivot 68 permits folding of the lower frame 26 so that the forward ends 56, 58 are adjacent one another. FIGS. 5 and 6 illustrate frame 26 of the preferred embodiment in a deployed and folded position. When folded, ends 56, 58 extend inwardly of their respective ends 70, 72 and may be positioned adjacent to each other, as shown in FIG. 5, or they may overlap each other. In the folded position, a length dimension A of the lower frame 26 may be defined by the distance between bends 112 and 114 of the lower frame 26. Alternatively, length dimension A may be defined by the distance between ends 56, 58, which would correspond to members 54, 52 overlapping each other when lower frame 26 is folded. When deployed, ends 56, 58 extend outwardly from ends 70, 72. The distance between ends 56, 58 define a length dimension B which approximates the overall width of bouncer seat 10 when configured for use. As will be readily understood by the skilled artisan and which is also readily apparent from the examples of the preferred embodiment (e.g., by comparing FIGS. 5 and 6), by providing pivot 68, there results a significant reduction in overall shipping size, thereby reducing costs in shipping of the bouncer seat 10 to an end purchaser. Pivot 68 is preferably formed by providing receiving holes in ends 70, 72 and positioning each of the respective holes on top of each other so as to define a through hole for a fastener. The fastener may correspond to a threaded fastener with a locking nut, a pin, a screw in a plastic retainer or any other suitably type of fastener which permits rotational motion between members 54 and 52. Preferably, a threaded fastener with a nut is used. In operation, lower frame 26 is may be positioned in the folded position (e.g., FIG. 5) when packaged. At the point of purchase, a consumer may then be instructed to rotate lower frame 26 to the unfolded position. Once this operation is complete a consumer may then insert ends 56, 58 into their respective receptacles 60, 62. Button fasteners, or other similar fasteners, can secure the forward ends 56, 58 in the second receptacles 60, 62.

As mentioned above, the second housings 64, 66 can be coupled to the first housings 48, 50 to permit the lower frame 26 to pivot relative to the upper frame 24. FIGS. 7–10 illustrate a preferred embodiment of the assembly of this mechanism which accomplishes this motion. These figures show only the left hub assembly 28 with the understanding that the right hub assembly 30 is a mirror image.

Figure 7:
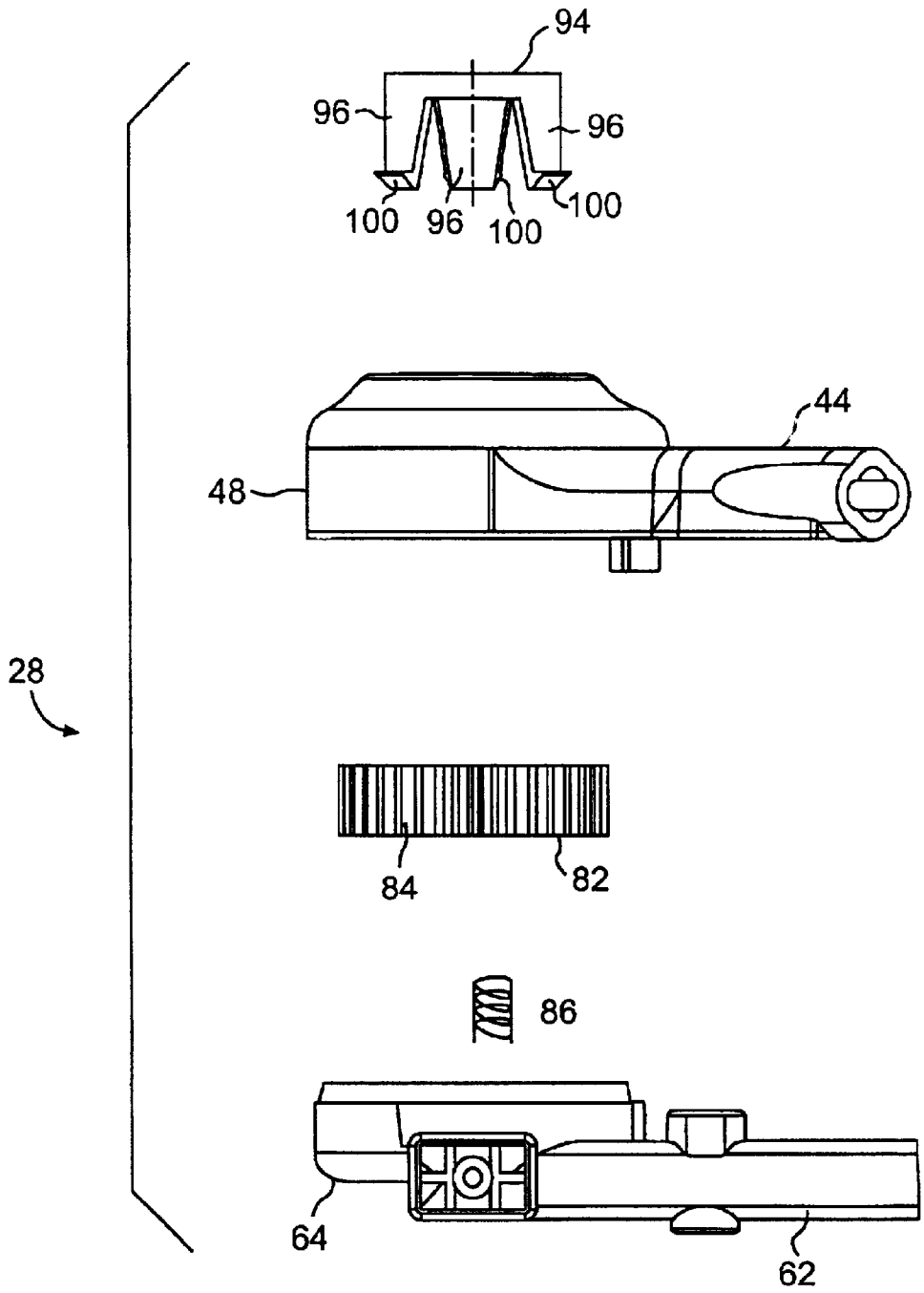
FIG. 7 is an exploded view of a hub assembly of the frame of FIG. 3.

The first housing 48 (FIGS. 7, 8) includes a first cavity 74 with teeth 76 circumferentially spaced and extending radially inwardly. The second housing 64 (FIGS. 7, 9) includes a second cavity 78 with teeth 80 circumferentially spaced and extending radially inwardly. The first and second cavities 74, 78 contain a gear 82 (FIGS. 7, 10) having teeth 84 that are engageable with the teeth 76, 80 of the first and second housings 48, 64. As shown in FIG. 7, a spring 86 lies between the gear 82 and the second cavity 78 of the second housing 64 to bias the gear 82 toward the first cavity 74 of the first housing 48.

Figure 8:
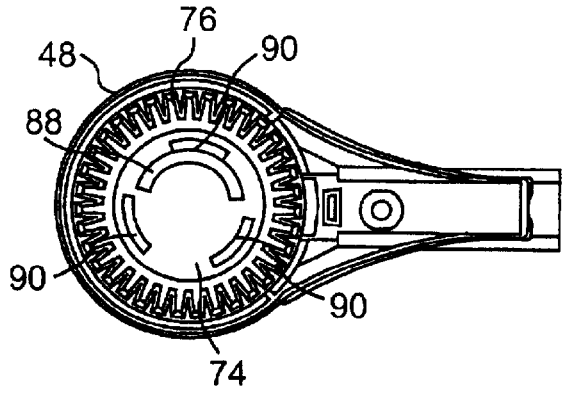
FIG. 8 is a top view of a first component of the hub assembly of FIG. 5.
Figure 9:
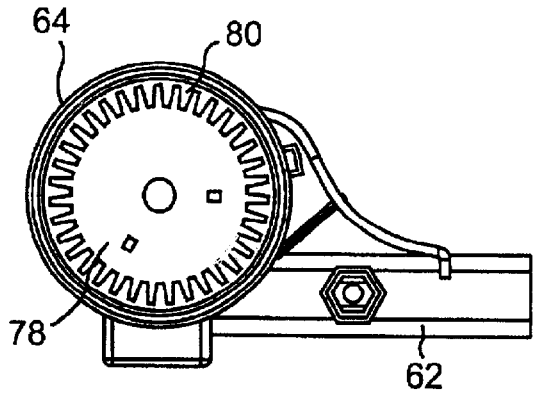
FIG. 9 is a top view of a second component of the hub assembly of FIG. 5.
Figure 10:
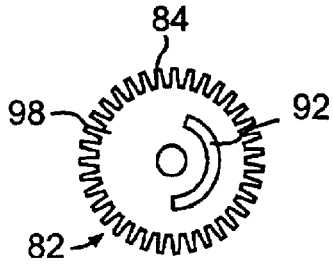
FIG. 10 is a top view of a third component of the hub assembly of FIG. 5.

Referring to FIG. 8, the first cavity 74 further includes a semi-circular wall 88 and three arcuate slots 90 circumferentially spaced about the first cavity 74. The gear 82 also includes a semi-circular wall 92 that extends toward the first housing's cavity 74 (see FIGS. 7 and 10). The semi-circular walls 88, 92 have the same height and diametrically oppose one another to support the gear 82 in a position in which the gear's teeth 84 simultaneously engage both sets of teeth 76, 80 in the first and second housings 48, 64 under the bias of the spring 86. The gear 82 rigidly locks the first housing 48 relative to the second housing 64 to secure frame assembly 12 in the upstanding or use position, FIG. 3, or folded position, FIG. 2.

Again referring to FIG. 7, a button 94 has three projections 96 that align with a respective one of the arcuate slots 90 formed in the first cavity 74. These projections 96 extend from outside the first housing 48 into the first cavity 74 and abut the face 98 of the gear 82. Each projection 96 has a tab 100 formed at its end that snaps into a respective slot 90 to prevent separation of the button 94 from the first housing 48. Depressing the button 94 displaces the gear 82 into the second cavity 78 and disengages the gear's teeth 84 from the teeth 76 in the first cavity 74. This unlocks the first and second housings 48, 64 so that the lower frame 26 can pivot relative to the upper frame 24. The teeth 76, 80, 84 on each of the first cavity 74, the second cavity 78 and the gear 82 cooperate to define a plurality of angular positions of the lower frame 26 relative to the upper frame 24. Preferably, this arrangement provides a plurality of positions for the seat back 38 relative to lower frame 26, as well as allowing the frame assembly 12 to fold substantially flat.

Selectively locking the first and second housings 48, 64 can occur by other arrangements such a ratchet and pawl device, a ball and detent mechanism, or a pin insertable into one of a plurality of circumferentially spaced holes in one of the housings 48, 64 when aligned with a similar one of a plurality of holes in the other of the housings 48, 64.

Figure 11:
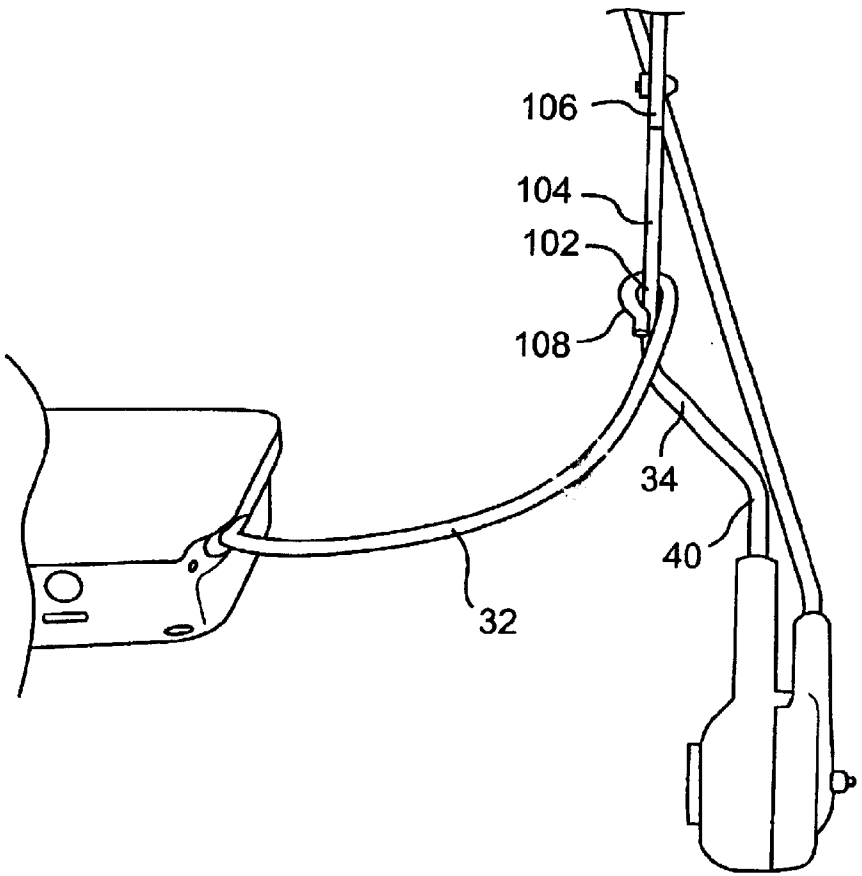
FIG. 11 is a first enlarged view of a portion of the frame of FIG. 3.
Figure 12:
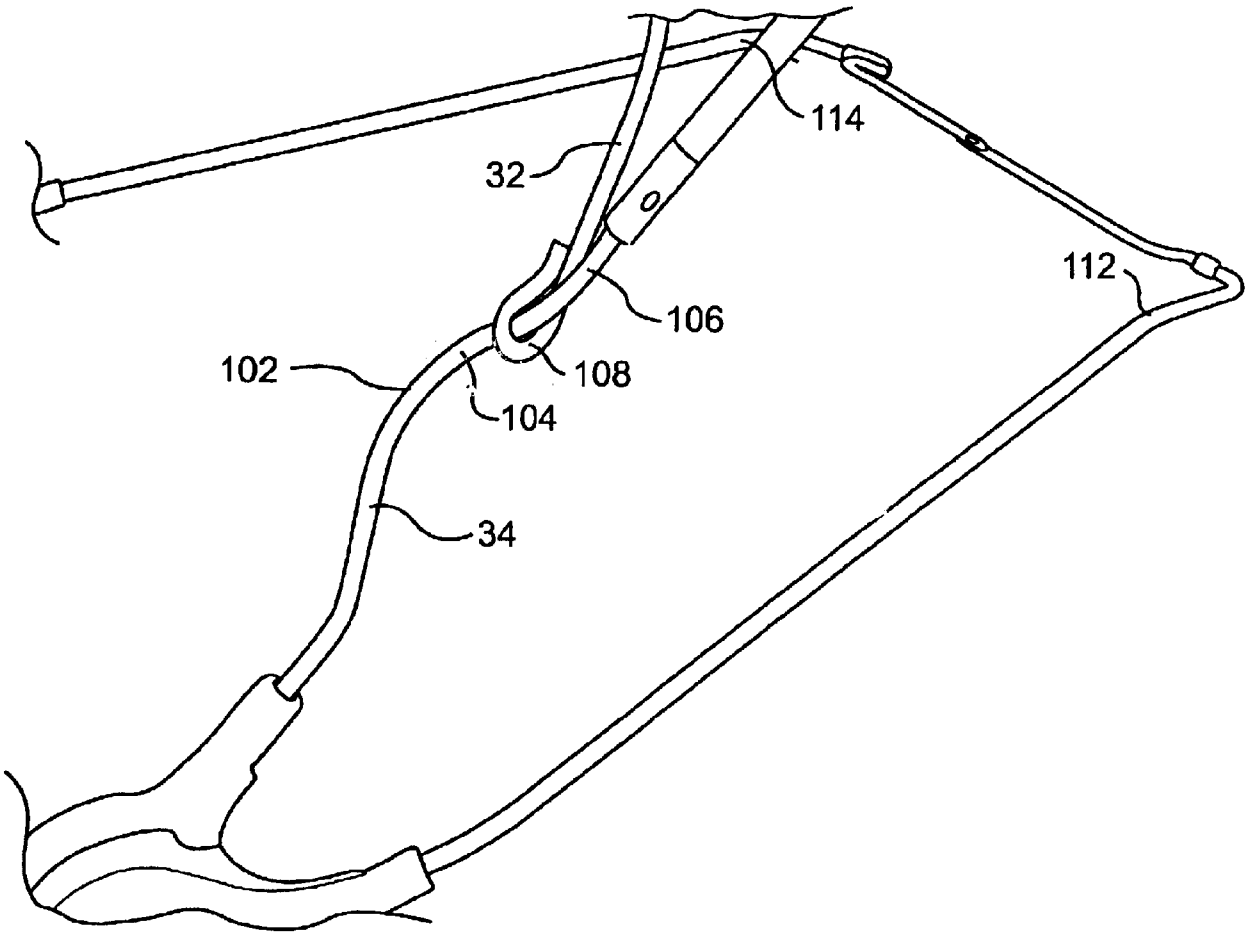
FIG. 12 is a second enlarged view of a portion of the frame of FIG. 3.

FIGS. 11 and 12 show enlarged views of the left bend 34 and the intermediate frame 32 in the use position (FIG. 11) and the folded position (FIG. 12). The left bend 34 is preferably a serpentine bend and includes a first section 102, a second section 104 and a third section 106. The ends 108, 110 of the intermediate frame 32 wrap around the upper frame 24 by forming an eyelet in intermediate frame 32, only the left end 108 is shown in FIGS. 11 and 12. The bend 34 provides a section of frame which protrudes forwardly relative to the portion of frame extending above bend 34. By providing a bend in upper frame 24, a support surface (e.g., section 104) for intermediate frame 32 may be provided when intermediate frame 32 is cantilevered from upper frame 24 (FIG. 11). Additionally, outwardly extending bend 34 allows intermediate frame 32 to be rotated about bend 34 at section 104 so that intermediate frame 32 may be laid substantially flat against upper frame 24 (see FIGS. 12 and 2). Preferably, the lower end of left end 40 of upper frame 24 extends outwardly below bend 34. This extension prevents intermediate 32 from slipping off of bend 34. Upper frame 24 may also be constructed as a three piece frame. For example, the generally U-shaped seat back portion 38 may be removable from bends 34, 36 just above section 106 (a similar connection could be provided at bend 36) and securable to bend 34 by a pin or other type of fastener. This alternative embodiment could be employed if it is desirable to further reduce the packaging size of bouncer seat 10. Other methods of pivotally attaching the intermediate frame 32 to the upper frame 24 are possible, such as a pin connection between upper frame 24 and intermediate frame 32, a housing assembly secured to upper frame 24 which rotably receives intermediate frame 32. Intermediate frame 32 can also include a similarly shaped eyelet which is positioned to rest against a bump formed in upper frame 24 to support intermediate frame 32 as a cantilever.

In the preferred embodiment, the left end 108 of the intermediate frame 32 contacts the top of the first section 102 and the bottom of the second section 104 when the intermediate frame 32 is in the use position (see FIG. 11). This contact provides sufficient support for the intermediate frame 32 to extend as a cantilever from the upper frame 24. The left end 108 of the intermediate frame 32 lies along the third section 106 when the intermediate frame 32 is in the folded position (see FIG. 12). As mentioned above, the offset provided by, the bends 34, 36 permits the intermediate frame 32 and lower frame 26 to lie substantially flat with respect to the upper frame 24 when the frame assembly 12 is folded (see, e.g., FIG. 2). While the preferred embodiment discloses a serpentine bend, other shapes can be used to provide the same or similar function (for example, a housing, as mentioned above). The right bend 36 is identical in shape and function to the left bend 34 and cooperates with the right end 110 of the intermediate frame 32.

The left and right members 52, 54 can be L-shaped with bends 112, 114 formed between the long and short legs. The bends 112, 114 create an angled clearance between the support surface and the lower frame 26 (see, e.g., FIG. 3). This clearance is provided so that lower frame 26 will flex during use, thereby providing a bouncing motion. This frame design is preferred because it simplifies the design of the hub assemblies 28, 30 (bouncing motion need not be provided by hub assemblies 28, 30).

Other types of frames may be used in place of lower frame 26 without departing from the scope of the invention. For example, pivot 68 could be positioned adjacent one of bends 112, 114 (as opposed to midway between bends 112, 114), thereby providing a lower frame having a left or right member essentially rotatably coupled to the other left or right member. A lower frame may also be provided which uses two pivots, each located near the respective bends 112, 114. In this design, a lower frame having a member extending between the left and right members would be pivotal relative to each of a left and right forwardly extending lower frame member. A folded lower frame for two pivots would allow left and right members to be positioned adjacent each other in the folded position.

In an alternative embodiment, lower frame may be positionable between folded and deployed positions by employing a coupling that permits ends 70, 72 to be linearly displaceable (i.e., as opposed to rotational displaceable) relative to each other by providing longitudinally extending grooves in each of ends 70, 72. In this embodiment, lower frame 26 may be positionable from the deployed to folded position by, e.g. loosening a fastener securing ends 70, 72 in the deployed position and then sliding end 70 relative to end 72 so as to position end 70 of left member 52 closer to forwardly extending portion of right member 54 and end 72 of right member 54 closer to forwardly extending portion of left member 52. A coupling which permits sliding of end 70 relative to end 72 may also permit rotation between ends 70, 72, thereby providing a more collapsed state for lower frame 26. In yet another embodiment, a coupling may be provided which allows members 52, 54 to be folded over each other (e.g., member 52 lies on top of member 54 when in the folded position). In yet another embodiment, ends 70, 72 may be pivotally coupled to the respective members 52, 54 and to each other, thereby providing a linkage system between members 52, 54. In other embodiments, pivot 68 may be provided adjacent the forwardly extending portion of member 52 or member 54. Although it is preferred to have each of forward ends 56, 58 removed from second receptacles 60, 62 when lower frame 26 is positioned in a folded position, only one of forward ends 56, 58 need be removed. In yet another embodiment, seat 10 may provide a lower frame 26 that is foldable between folded and deployed positions without removing forward ends 56, 58 from second receptacles 60, 62. In this embodiment, either upper frame 24 may be removable from first receptacles 44, 46 or upper frame may be foldable so as to permit folding of the lower frame 24.

It will be apparent to those skilled in the art that various modifications and variations can be made in the child bouncer of the present invention without departing from the spirit or scope of the invention.

What is claimed is:

1. A frame assembly for a child bouncer seat adapted for use on a supporting surface, the frame assembly including a disassembled configuration and an assembled configuration, comprising:

an upper frame including left and right ends;

left and right hub assemblies each of the hub assemblies including a first receptacle coupled to a respective one of the left and right ends of the upper frame in the assembled configuration, and a second receptacle;

a lower frame for supporting the upper frame in the assembled configuration, the lower frame including left and right members each having a respective forward end a rearward end, and a supporting surface contacting portion, wherein the forward ends of the left and right members are connected to the second receptacles of the hub assemblies in the assembled configuration; and a pivot connecting the rearward ends of the left and right members, wherein in the disassembled configuration, one of the left and right members of the lower frame is adapted to be rotated about the pivot so as to allow the one of the left and right members to be positioned between first and second angular positions relative to the other of the left and right members, and wherein in the assembled configuration, the forward ends of the left and right members being connected to the second receptacles of the hub assemblies and the left and right members are prevented from rotating about the pivot.

2. The frame assembly of claim 1 wherein the left and right members are L-shaped.

3. The frame assembly of claim 2, wherein each of the left and right L-shaped members includes a relatively short leg and a relatively long leg, wherein the pivot connects the left L-shaped member to the right L-shaped member proximate the relatively short legs.

4. The frame assembly of claim 3, wherein the pivot is disposed approximately equidistant from the relatively long legs of the left L-shaped member and the right L-shaped member.

5. The frame assembly of claim 4, wherein the pivot is a fastener received within a pair of cooperating holes formed in the relatively short legs of the left L-shaped member and the right L-shaped member.

6. The frame assembly of claim 1, wherein the hub assemblies are rigid relative to the lower frame and wherein portions of the left and right members are elevated from the supporting surface so as to be resiliently displaceable relative to the hub assemblies, the elevated portions defining a flexural member providing bouncing motion to the frame assembly in the assembled configuration.

7. The frame assembly of claim 6 wherein the left and right hub assemblies are disposed adjacent the supporting surface.

8. The frame assembly of claim 1, wherein the first angular position is formed by the forward ends of the left and right members being spaced from each other and the second angular position is formed by the forward ends of the left and right members being positioned approximately adjacent each other.

9. The frame assembly of claim 1 wherein the lower frame is moveable between at least one unfolded position in which the lower frame is angularly displaced from the upper frame and a folded position in which the lower frame lies substantially co-planar with the upper frame.

10. The frame assembly of claim 9 wherein the left and right hub assemblies are positionable between at least one first orientation and a second orientation, the at least one first orientation corresponding to the first receptacles of the hubs being rotationally offset from the second receptacles of the hub assemblies and the second orientation corresponding to the first receptacles of the hubs being rotationally parallel to the second receptacles of the hub assemblies.

11. The frame assembly of claim 1 further comprising an intermediate frame coupled to the upper frame.

12. The frame assembly of claim 11 wherein the intermediate frame is pivotable between a first position adjacent the upper frame and a second position angularly spaced from the upper frame.

13. The frame assembly of claim 1 wherein each of the hubs assemblies includes a first housing and a second housing;

the first housing including a first gear surface, a button, and the first receptacle;

the second housing including a second gear surface and the second receptacle;

the first and second gear surfaces being circular in shape and including radially extending teeth; and a gear having teeth engageable with each of the first and second gear surfaces and wherein the button is adapted to engage the gear.

14. The frame assembly of claim 13 wherein the button and the gear are displaceable relative to the first and second housings to disengage the gear from at least one of the first and second gear surfaces so that the first housing is rotatable relative to the second housing.

15. The frame assembly of claim 1 wherein the upper frame is a seat support adapted to receive a seating surface; and the left and right ends of the upper frame extend forwardly and outwardly from the seating surface to the hub assemblies and the left and right members of the lower frame extend rearwardly and inwardly from the hub assemblies.

16. The frame assembly of claim 1, wherein in the assembled configuration, the frame assembly occupies an assembled width defined by the distance between the hub assembles; and wherein in the disassembled configuration, the hub assemblies are disconnected from the upper frame and the lower frame assembly occupies a disassembled width defined by a distance between the lower frame left and right members, the disassembled width being less than the assembled width.

17. A child seat comprising:

a first frame member including a seat back portion and left and right ends, each of the left and right ends including a curved portion;

a second frame member having left and right portions, each of the left and right portions of the second frame member comprising a loop pivotally coupled about the curved portions of the first frame member; and wherein the second frame member is rotatable about the curved portions between a deployed position in which the second frame member is angularly spaced from the first frame member so as to provide a seat support, and a folded position in which the second frame member is substantially co-planar with the first frame member.

18. The child seat of claim 17 wherein the curved portions are serpentine in shape.

19. The child seat of claim 17 wherein the first frame member is a unitary member.

20. The child seat of claim 17 wherein the second frame member is a unitary member.

21. The child seat of claim 17 wherein the seat back portion defines a plane and wherein each of the curved portions is serpentine in shape and includes a first, second and third section, the second section extending forwardly from the plane of the seat back portion and being disposed between the first and third sections, and the first and third sections extending approximately parallel to the plane of the seat back portion; and wherein the second section and the first section of the curved portions supports the second frame member in the deployed position.

22. The child seat of claim 21, wherein the second frame member is rotated about the second section when the second frame member is positioned in the folded position.

23. The child seat of claim 17, wherein the first and second frame members are formed from a wire form material.

24. The child seat of claim 17 further including a ground engaging base coupled to the left and right ends of the first frame member.

25. The child seat of claim 24 wherein the ground engaging base includes left and right base portions and wherein the ground engaging base is pivotally coupled to the left and right ends of the first frame member by left and right hub assemblies, each hub assembly having a first portion connected to a respective one of the left and right ends of the first frame member and a second portion connected to a respective one of the left and base right portions.

26. The child seat of claim 25 wherein the ground engaging base is displaceable relative to the seat back portion to position the ground engaging base substantially co-planar with the seat back portion when the second frame member is in the folded position.

27. The child seat of claim 17 wherein the child seat is a bouncer seat.

28. A child seat adapted for use on a supporting surface and having an assembled and disassembled configuration, the child seat comprising:

a seating portion including an upper frame;

a lower frame adapted to contact the supporting surface, the lower frame including left and right L-shaped members spaced apart by a first distance in the assembled configuration, each of the L-shaped members including a forwardly and outwardly extending forward portion defining a forward end, and a transverse rear portion defining a rearward end, wherein the left and right L-shaped members are connected by a lower frame connector proximate their rearward ends, the upper frame being connected to the lower frame; and wherein movement of the child seat between the assembled configuration and the disassembled configuration is effected by moving the left and right L-shaped members about the lower frame connector so that the left and right L-shaped members are spaced apart by a second distance, the second distance being less than the first distance.

29. The child seat according to claim 28, wherein movement of the child seat between the disassembled configuration and the assembled configuration is effected by moving the left and right L-shaped members about the lower frame connector until the left and right L-shaped members are spaced apart by the first distance.

30. The child seat according to claim 29, wherein the lower frame connector comprises a pivotal connection.

31. The child seat according to claim 30, wherein the pivotal connection is centrally disposed between the rearward ends of the L-shaped members.

32. The child seat according to claim 31, wherein the pivotal connection comprises a pin passing through a hole formed in each of the rearward ends of the L-shaped members.

33. The child seat according to claim 28, wherein the upper frame is connected to the lower frame via hubs, the hubs adapted for rotating the seating portion relative to the lower frame so as to enable reduction in a maximum height of the child seat when configured in the disassembled configuration.

34. A method for assembly of a child's bouncer seat, comprising the steps of:

providing a bouncer seat assembly, the assembly including an upper frame defining a maximum disassembled width of the seat assembly, left and right sides including rotatable hubs, a ground engaging, stabilization frame including a pair of L-shaped legs, each of the L-shaped legs including a forward leg portion and a rear leg portion, the rear leg portions being coupled to each other by a pivot at a first end thereof, and each of the rear leg portions being connected to the respective forward leg portion at a second end thereof;

connecting the left and right hubs to the upper frame;

deploying the ground engaging, stabilization frame including pivoting the rear leg portions about the pivot from a first stowed angle defined by the rear leg portions to a second angle defined by the rear leg portions, the second deployed angle being greater than the first stowed angle; and connecting the forward leg portions to the left and right hubs so that the second ends are spaced apart by a distance greater than the maximum disassembled width.

35. The method according to claim 34, further comprising rotating the hubs to pivot the upper frame relative to the ground engaging, stabilization frame from a collapsed position to a deployed position.

36. The method of claim 35, further comprising the step of providing an actuator on at least one of the hubs to permit rotation of the upper frame relative to the ground engaging, stabilization frame, wherein the step of rotating the hubs further includes the step of actuating the actuator to permit rotational motion between the upper frame and ground engaging, stabilization frame.

37. The method according to claim 34, wherein the upper frame comprises a U-shaped upper frame.

* * * * *